United States Patent [19]

Lang

[11] Patent Number: 4,819,521

[45] **Date of Patent: * Apr. 11, 1989**

[54] RATCHET BOX WRENCH WITH OFFSET HANDLE

[75] Inventor: John W. Lang, Racine, Wis.

[73] Assignee: A & E Manufacturing Company, Racine, Wis.

[ * ] Notice: The portion of the term of this patent subsequent to Jun. 7, 2005 has been disclaimed.

[21] Appl. No.: 168,688

[22] Filed: Mar. 16, 1988

Related U.S. Application Data

[63] Continuation of Ser. No. 375,419, May 6, 1982, Pat. No. 4,748,875.

[51] Int. Cl.[4] ..... B25B 13/46

[52] U.S. Cl. ..... 81/63; 81/177.1

[58] Field of Search ..... 81/60–63.2, 81/177.85, 177.1

[56] References Cited

U.S. PATENT DOCUMENTS

| | | | |
|---|---|---|---|
| 2,185,002 | 12/1939 | Pack | 81/63 |
| 2,712,258 | 7/1955 | Keith | 81/63 |
| 2,769,360 | 11/1956 | Cottrell et al. . | |
| 3,635,654 | 1/1972 | McFarland | 81/63 |
| 4,276,791 | 7/1981 | Thompson | 81/62 |

FOREIGN PATENT DOCUMENTS

| | | | |
|---|---|---|---|
| 2206692 | 6/1974 | France . | |
| 13448 | of 1904 | United Kingdom | 81/63 |
| 842080 | 7/1960 | United Kingdom | 81/60 |
| 1216225 | 12/1970 | United Kingdom | 81/62 |
| 1374052 | 11/1974 | United Kingdom . | |

*Primary Examiner*—Debra Meislin

*Attorney, Agent, or Firm*—Fuller, Puerner & Hohenfeldt

[57] ABSTRACT

A reversible ratchet wrench employing spaced plates which hold the sockets and ratchet mechanism in assembly has an offset handle to provide clearance for the hand of the user. The pawl of the ratchet mechanism is in the head portion of the wrench adjacent the socket and the spring-loaded plunger is supported in the handle portion. The pawl and plunger engage at an oblique angle at a juncture zone between the handle portion and the socket head portion, which juncture zone affords clearance for operative movement of the ratchet and plunger during use.

1 Claim, 1 Drawing Sheet

RATCHET BOX WRENCH WITH OFFSET HANDLE

This is a continuation of co-pending application Ser. No. 375,419, filed on May 6, 1982, now U.S. Pat. No. 4,748,875.

BACKGROUND OF THE INVENTION

It is known to have wrenches, both box and open-ended, having the wrench heads offset from the handle portion so that it is convenient to use the wrench to manipulate bolts and nuts over a wide surface with clearance for the fingers or hand. It also is known to have a ratcheting wrench with an offset handle in a forged, relatively expensive wrench construction. Heretofore the art has not provided a ratcheting box wrench with offset handle in the popular wrench construction which utilizes opposed spaced plates which support the sockets.

SUMMARY OF THE INVENTION

The invention provides a ratcheting box wrench for a spaced plate wrench with offset handle in which the ratcheting pawl is located in the head portion of the wrench which rotatably supports the sockets and a spring-loaded plunger is supported for reciprocation in the offset handle, with the plunger engaging the pawl at a juncture zone between the angularly related offset head and handle plate portions. By locating the point of engagement between the plunger and pawl at the juncture, typical and conventional pawl and plunger parts can be employed so that the offset design can be utilized in relatively small spaced plate wrenches. If the ratcheting parts were not divided between the head portion and handle portion but all were contained in the head portion, the design disclosed herein would not be practical or usable in small wrenches because the ratcheting mechanism requires a certain length to accommodate both the pawl and the spring-mounted plunger. Because the pawl must engage teeth on the socket, the pawl must be pivotally supported in the same plates in the head portion that support the socket. Thus the entire ratcheting mechanism cannot be located in the handle.

The juncture zone of the wrench of the invention affords engagement of the pawl and plunger during their normal range of movements without interference with the inside surface of spaced plates which support these parts in this operative relationship.

Further objects, features and advantages of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
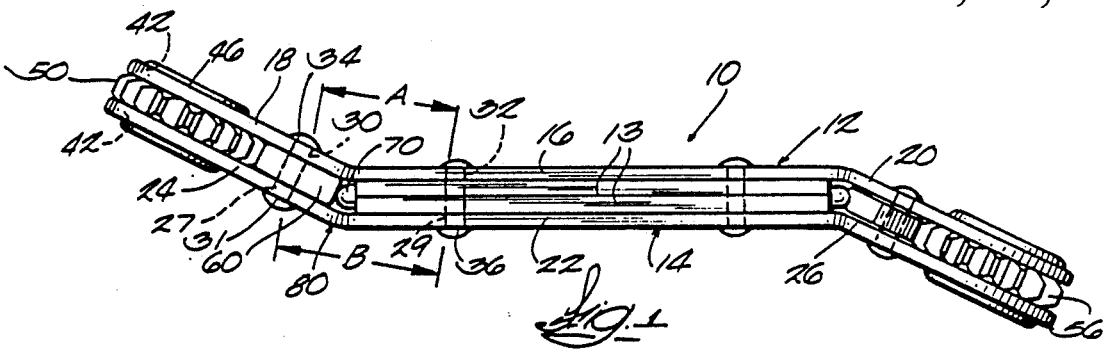
FIG. 1 is a side view of the box wrench in accordance with the invention.

In the drawings, FIG. 1 shows a ratcheting box wrench 10 with plates 12 and 14 separated by spacers 13. Plate 12 has an elongated handle portion 16 with an upturned head portion 18 and a downturned head portion 20. Plate 14 has a handle portion 22, upturned head portion 24 and downturned head portion 26.

The plates 12 and 14 can be stamped as identical parts. However, because of the oblique angle between the handle portions and head portions, the distance between the apertures 30 and 32 in plate 12 for the pawl-supporting rivet 34 and the handle-securing rivet 36 are of different spacing than the corresponding apertures 27 and 29 in plate 14. As illustrated in FIG. 1, the distance A is less than the distance B. Accordingly, the holes cannot be drilled or punched at the same spacing for both plates 12 and 14. Otherwise the parts could not be assembled. In conventional plate wrenches, the plates and holes can be stamped in the same die.

Figure 4:
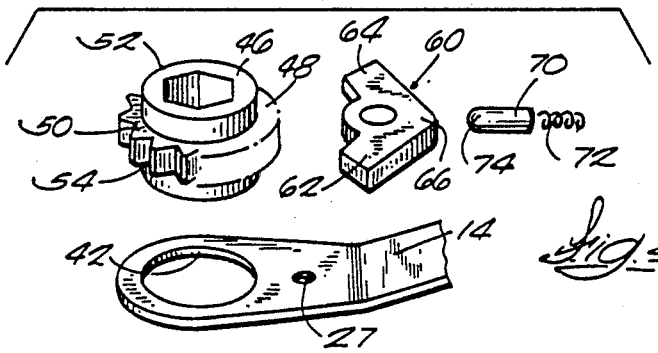
FIG. 4 is a perspective view of the socket and ratcheting mechanism illustrated in FIGS. 1 through 3.

The head portions 18 and 24 have apertures 42 which are aligned when the plates are assembled and support a socket 46 which has a central rib 48 (FIG. 4) with gear teeth 50 and upper and lower shoulders 52 and 54. The shoulders 52 and 54 are journaled in the openings 42 in the plates.

Figure 2:
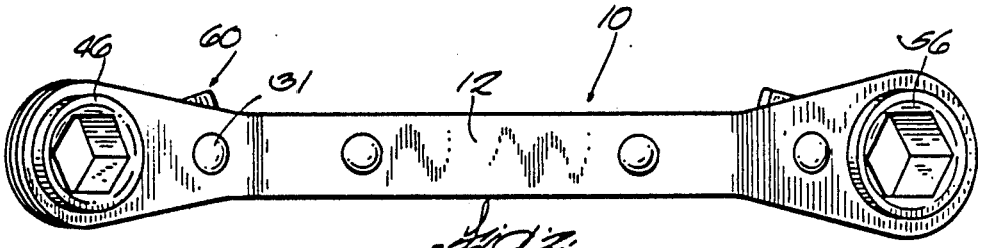
FIG. 2 is a top view of the wrench shown in FIG. 1.

Similarly, the opposite end of the wrench (FIG. 2) is provided with a socket 56 which desirably is of a different size than the socket 46.

A reversible ratcheting mechanism is provided for both sockets, which include a pawl 60 which is pivotally supported on the rivet 34 and which includes teeth 62 and 64 and a nose 66. The teeth 62 and 64 project from the outline of the handle to afford manual manipulation to select the appropriate position of the pawl for the desired torquing direction. With the pawl in the solid line position shown in FIG. 3, the tooth 62 will prevent clockwise rotation of the socket relative to the handle to permit clockwise torquing but will afford ratcheting or slipping of the handle relative to the socket in a counter-clockwise direction to enable the user to restore the handle to the starting point for repeated torquing in the same direction within a limited arc.

The pawl 60 is retained in the selected position by a plunger 70 which is biased or urged outwardly by a spring 72 which is located between the plunger tip 74 and a rivet 36. The plunger 70 and spring 72 are confined in slots 73 in the spacers. The plunger can be depressed by manual manipulation of the pawl to switch the pawl from one side to the other by ratcheting movement of the wrench handle but is not depressed by torquing pressure on the socket when the pawl is in the appropriate position.

Figure 3:
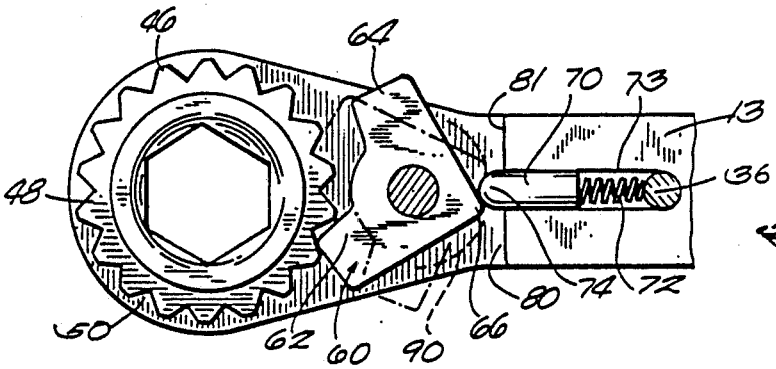
FIG. 3 is a fragmentary enlarged view of the ratcheting mechanism of the wrench shown in FIG. 1.

In accordance with the invention, the plunger length and zone of reciprocating travel are selected so that the operative engagement between the plunger tip 74 and the nose 66 of the pawl is located at the juncture zone 80 between the angularly related head and handle plate portions. The clearance at the juncture zone between the end 81 of the spacers and the rivet 31 enables the nose 66 to swing in an arc 90, as illustrated in FIG. 3, at the juncture 80. If the nose of the pawl extended beyond the juncture 80, it would interfere with and engage the inside surface of the handle portions, which would prevent free pivotal movement. Similarly, the plunger would contact the inside surface of the head plate portions if it extended beyond the juncture zone any significant amount.

Although in the disclosed construction the sockets illustrated have size surfaces, sockets with twelve faces could also be employed. Also, in some size wrenches the spring 72 could be bottomed in the end wall of the slot rather than against the rivet. Other such modifications are within the purview of the invention.

The advantages of the offset handle of the invention are apparent. The clearance afforded facilitates manual manipulation and also provides clearance over adjacent bolt heads. The pawl is within the outline of the enlarged socket head, so inadvertent displacement of the pawl caused by hitting a wall, etc. is minimized as compared with the prior art forced wrench which has a protruding part of the ratched mechanism which is easily displaced.

I claim:

1. In a wrench having opposed upper and lower plates defining a plate handle portion with spacers separating the plates, sockets, and said plates having integral plate head portions with socket apertures at the ends of the handle portion for receiving and supporting said sockets, and said plate head portions having rivet apertures and said upper plate head portion forming a first juncture with said upper plate handle portion and said lower plate forming a second juncture with said lower plate portion and wherein said sockets are provided with peripheral teeth, and ratchet means for locking said socket against rotation in one of clockwise or counter-clockwise direction while permitting ratcheting movement in the other of the clockwise and counter-clockwise direction, said ratchet means including a pawl having corners engageable with said peripheral teeth, said pawl being pivotally supported by the socket plate head portions, the improvement wherein said head portions are offset at an oblique angle with respect to said plate handle portion, said angle facilitating manipulation of said wrench and providing clearance beneath the wrench for the user's fingers, and said pawl having a pawl part oppositely located with respect to said sockets and movable in an arc at the juncture of said plate head portions and said plate handle portion and between said plates, and a spring-loaded plunger projecting longitudinally from said handle portion into said juncture and engageable with said pawl part in said juncture to lock said ratchet means in the selected position for the desired torqueing direction, and wherein said pawl is supported by a rivet extending through rivet apertures in said upper and lower plate head portions, said rivet also securing said upper and lower plates together, and wherein the spacing of the rivet aperture on the upper plate portion from said first juncture is less than the spacing of the rivet aperture in said lower plate portion from said second juncture and wherein said plates are sized and rivet apertures spaced from the socket apertures so that when the plates are assembled the socket apertures and rivet apertures are aligned.

* * * * *